US005133401A

United States Patent [19]

Cisko et al.

[11] Patent Number: 5,133,401

[45] Date of Patent: Jul. 28, 1992

[54] CONTINUOUS CASTING MACHINE WITH MOLD BLOCK ASSEMBLIES INTERLINKED BY ELASTIC HINGES

[75] Inventors: Lawrence W. Cisko, Irwin; Ronald Bachowski; Joshua Liu, both of Murrysville; Michael M. Mohajery, Pittsburgh; S. John Pien, Export; Paul E. Ringbloom, Murrysville; Adam J. Sartschev, Allison Park; Albert C. Wang, Murrysville, all of Pa.

[73] Assignee: Aluminum Company of America, Pittsburgh, Pa.

[21] Appl. No.: 674,664

[22] Filed: Mar. 25, 1991

[51] Int. Cl.[5] ..... B22D 11/06

[52] U.S. Cl. ..... 164/430; 164/479

[58] Field of Search ..... 164/430, 431, 479

[56] References Cited

U.S. PATENT DOCUMENTS

| | | | |
|---|---|---|---|
| 3,570,586 | 3/1971 | Lauener | 164/279 |
| 3,747,666 | 7/1973 | Gyongyos | 164/279 |
| 4,895,202 | 1/1990 | Sato et al. | 164/430 |

*Primary Examiner*—Kuang Y. Lin

*Attorney, Agent, or Firm*—Alfred D. Lobo; David W. Pearce-Smith

[57] ABSTRACT

A continuous casting machine ("block caster") is provided with chain-wise interlinking of mold block assemblies. Such chain-wise interlinking maintains the mold block assemblies essentially contiguous and is essential to provide operation of a continuous casting machine essentially free of mechanical noise. Each mold block assembly is elastically independently hinged by dual parallel hingepins, spaced-apart in the casting direction (x-axis), as the mold block assembly is carried between opposed, transversely (y-axis) spaced-apart guide rails of each carriage track. The elastic hinge means compensates for variation in block-to-block (centerline) distance caused by kinematic phenomena, including thermally induced variations in the dimensions of individual blocks as a function of their position in each track during operation. Guide rollers guided in generally horizontal guide roller-ways are afforded no measurable tolerance relative to their vertical displacement, when the roller-ways are off-set. Microslitted faces of mold blocks minimizes their distortion due to thermal cycles.

21 Claims, 8 Drawing Sheets

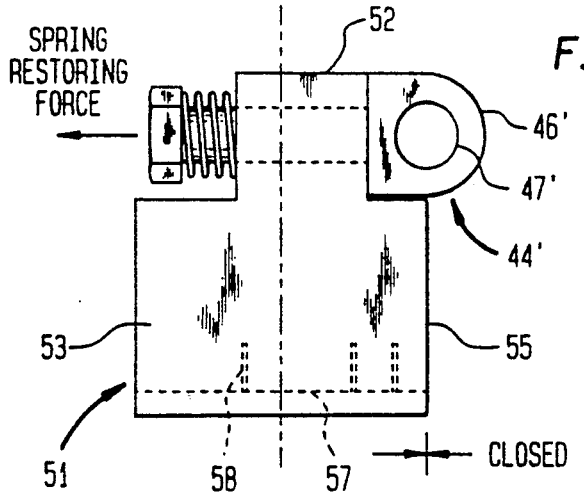
FIG. 4
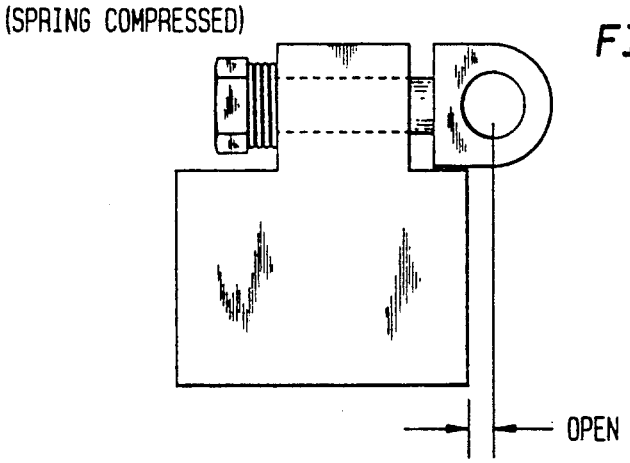
FIG. 5
FIG. 6
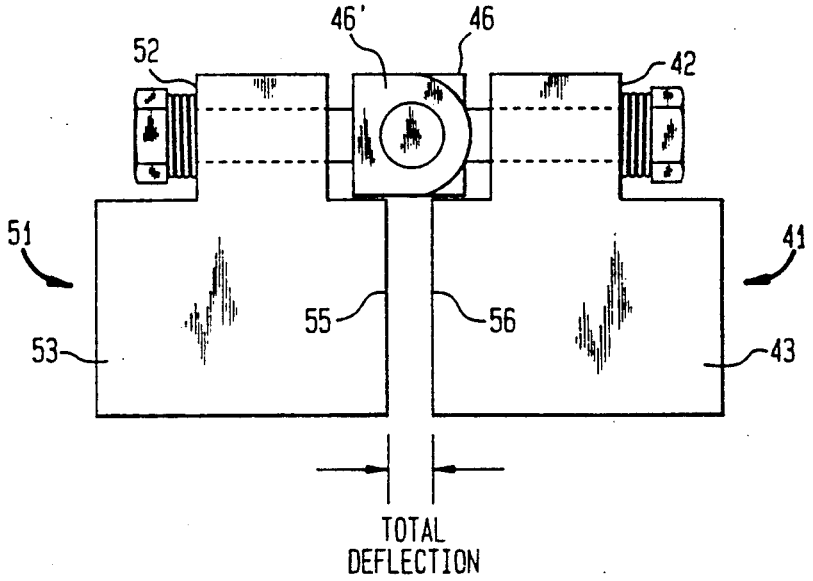

CONTINUOUS CASTING MACHINE WITH MOLD BLOCK ASSEMBLIES INTERLINKED BY ELASTIC HINGES

BACKGROUND OF THE INVENTION

In the past, many designs have been engineered to address the problem of translating the concept of continuously casting a molten metal using a moving mold incorporated within an operable and reliable machine. Towards this end, about 20 years ago, Lauener disclosed a continuous casting machine in U.S. Pat. No. 3,570,586, which used multiple mold block assemblies to form a continuous mold cavity from which metal emerged as a slab casting. For this reason, the machine is referred to as a "block caster" (or "slab caster"). Limited commercial success of the Lauener machine has, over the years spurred much effort towards refining the concept to build a machine to produce a quality slab casting, reliably and economically.

In a block caster, a pair of synchronously driven endless trains of mold block assemblies ("casting trains") travelling in paths which resemble loops, define a substantially linear mold cavity having open ends at each end, when the opposed faces of mold blocks in the mold block assemblies come together in spaced-apart relationship, facing each other, along the linear portions of the loops. Each loop has its linear portion connected by upper and lower arcuate portions or "bends" which complete the loops, and the mold block assemblies are endlessly interconnected and oppositely disposed relative to one another in the adjacent linear portions of the loops. The mold cavity is preferably defined in conjunction with "side dams" which together confine the molten metal in the moving mold cavity.

A casting nozzle is inserted near one open end, referred to as the "molten end", to supply the mold cavity with molten metal from a tundish. The molten metal cools as it progresses with the mold block assemblies until the slab emerges from the other open end, referred to as the "solid end". The longitudinal direction in which the molten metal is cast is referred to as the "casting direction" or the x-axis. The lateral direction, transverse to that in which the metal is cast, is referred to as the "transverse direction" or y-axis; and the vertically spaced-apart distance of the mold block faces which define the thickness of the cast slab is said to be in the vertical direction, or z-axis.

As one might expect, to cast a slab with rectangular cross-section, it is essential that the faces of the mold blocks defining the upper surface of the slab be in the same plane, and that the faces of those mold blocks defining the lower surface of the slab be in the same plane. When any portion of the face of a mold block is displaced from its original planar configuration, the slab will not have planar upper and lower surfaces. Depending upon the type of displacement, the surfaces will be arcuate, rippled or striated.

Portions of each mold block face in a zone near the block's surface are displaced because these portions get progressively hotter as they move through a primary process zone in contact with molten metal at the molten end. These portions near the surface then progressively cool as heat is transferred into the body of the block and the slab begins to cool as it reaches the solid end. The mold blocks are necessarily distorted due to temperature differences associated with the temperature gradients which are three-dimensionally distributed through the mold block. As the mold blocks cool and the molten metal soldifies, their original dimensions begin to be restored, returning to normal when sufficiently cooled. It is the distortion of the mold blocks during operation which must be dealt with. The choice is either to counteract the distortion, or to compensate for it. How one designs and constructs a block caster depends on the choice.

Under actual operating conditions, the distortions of the mold blocks are such that they exert enormous pressure against contiguous mold blocks forcing the metal of the blocks out of their planar conformance in edge-abutting protuberances, referred to as "bumps" described in greater detail in FIGS. 10–12. These bumps interfere with the smoothly planar definition of the surfaces of the upper and lower series of mold block faces. As a result, the upper and lower surfaces of the slab are neither planar nor smooth (that is, have poor "surface accuracy"). Such a slab is unacceptable in commerce because its surface contains cracks, or, provides locations from which cracks can propagate when the slab is rolled. A slab with poor surface accuracy is evidence of the "casting problem"—the less accurate the surface, the greater the problem.

As indicated above, the design and construction of a block caster derives from a fundamental decision whether to restrain the forces of distortion by equal and opposite restraints, or, to control and limit the distortions without substantially restraining them, and to cope with the controlled distortion.

We decided that the first step towards solving the well-recognized problem of poor surface accuracy was to provide a machine designed to allow the mold blocks to undergo their cyclical thermal changes without substantially restraining them, yet without interfering with the continuously planar configuration of the opposed surfaces of the mold cavity. To this end we provided barely visible slits (referred to as "microslits") of critical width and depth relative to the dimensions of a mold block, cut (in the casting direction, or at an acute angle thereto) in the face of each mold block.

Despite the microslits, the distortion of the blocks was sufficient to require accommodating their displacement in the casting direction. Such accomodate, along with the requirement for sufficient tolerance between blocks to enable insertion of the last block in each casting train, resulted in relatively large "play" between next-adjacent blocks.

Such "play" is closely related to the foregoing problem of poor surface accuracy which is exacerbated by the high sensitivity of the casting, especially in its semi-molten state, to mechanical excitation, referred to as "mechanical noise". By mechanical noise we more particularly refer to a periodicity of events due to any periodic structural excitation as evidenced by a change in the mechanical properties of the casting. An example of such noise is provided by the vibrations transmitted to the mold blocks during operation. The level of vibration which at least in part generates such mechanical noise may be measured by an accelerometer. The severity of the contribution of such excitation has not been recognized, therefore not addressed in the prior art.

Even a relatively low level of mechanical noise is highly undesirable, yet inexplicably, the problem of nullifying its effects, appears never to have been successfully solved to our knowledge, even accidentally, in prior art continuous casting machines.

Evidence of such non-recognition of the effects of mechanical noise is provided in diagrammatic illustrations of numerous prior art continuous casting machines in which the faces of mold blocks in each carriage track, in or near the open ends of the mold cavity, are no longer contiguous. These diagrams show, in the "bends" of each continuous carriage track, that adjacent rectangular mold blocks have radially divergent corners, and circumferentially spaced-apart faces. When the mold blocks fall together due to gravity, one atop the other, the acceleration and immediate deceleration cause a succession of collisions. Such collisions (familiarly referred to as "bangs") occur near the bottoms of the bends in each carriage track. The desired geometry of the mold cavity is restored as each next-adjacent block is subjected to impact, but the mechanical noise so caused disrupts the solidification of molten metal throughout the casting.

We decided the second step was to minimize mechanical noise. We decided to provide interconnected mold block assemblies which would go around the bends without colliding with ("banging") one another.

Assuming one could provide a solution to each step of the problem, one must ensure continuous operation of the machine under enormous forces generated by exigent temperature conditions. Eventually, the forces generate surface defects in the mold faces which require that the mold blocks be replaceable. The more prone the blocks to permanent distortions, the more frequently they need to be replaced.

In the prior art, specifically the '586 Lauener machine, this need to replace mold blocks has dictated that they be endlessly connected so that each mold block assembly is rotatably disposed on a guide roll axle on only one side of the assembly, the other side being held by a guide member which permits both pivotable movement of the mold block and linear movement of the mold block in the casting direction. Thus interconnected in the prior art carriage tracks, each block is individually articulated so that it is pivotable about an axle in which a guide roll axle is journaled on one side, but slidably detachable from the guide roll axle of the next-adjacent mold block assembly. Though interconnected, the prior art mold block assemblies are not interlinked.

The combined movements, due to expansion and contraction, of separably interconnected, individually mounted but not interlinked mold block assemblies are insufficient to relieve the distortions of the mold blocks adequately, as is evident from the massive restraints required in the Lauener '586 machine.

Of far greater consequence is that the articulation of the mold blocks, as provided in the prior art, results in the mold block assemblies striking each other ("banging") as they necessarily accelerate around the bends, causing in turn, a high level of mechanical noise, sufficient to have a deleterious effect on the metal cast.

The inevitability of such banging action is readily deduced from illustrations of block casters in U.S. Pat. No. 3,570,586 to Lauener (class 164/subclass 430); U.S. Pat. No. 3,747,666 to Gyongyos (class 164/subclass 279); and U.S. Pat. No. 4,895,202 to Sato et al (class 164/subclass 340), inter alia.

As described in detail herebelow, the mold block assemblies of our invention are interlinked one to another, as if in a chain (hence referred to as "chain-wise linking"), which if opened to separate the ends of the chain, allows one to hold all the mold blocks supported by only the first at one end of the chain.

It occurred to us that the key to minimizing such mechanical noise lay in the chain-wise interlinking of mold block assemblies with elastic hinge means, so that the faces of the mold blocks were always essentially contiguous. By "essentially contiguous" we mean that if they are spaced apart ("gapped"), the gap is less than 0.050" (inch), preferably less than 0.020". In such a configuration, the faces of the mold blocks form a smoothly continuous arcuate surface in the bends. If the mold blocks could be biased against each other at all times, it seemed unlikely that there would be much mechanical noise. However, it would be impractical to insert the last mold block assembly into a loop, because of the inherent spatial restriction, unless the elasticized casting train permitted it.

Nor, unless the elasticized casting train permitted it, would chain-wise interlinking of the blocks permit compensation for the block-to-block centerline distances which would necessarily vary depending upon the instantaneous position of the block in a loop (kinematic considerations and machine tolerances) and the block's thermal condition at that moment (thermally induced dimensional variation).

Since the foregoing dictated that the spaced-apart relationship of every mold block in each loop be finitely controllable, it was evident that chain-wise interlinking of the mold blocks, if it could be done at all, was impractical unless the casting train could be elasticized.

Still further, we deduced that mechanical noise could be minimized by providing each loop with at least four arcs, with the radius of each being different.

Concisely stated, the problem with prior art continuous casting machines is that they were unable to dampen the mechanical excitation caused by the mold blocks banging against each other in the bends. Neither could the prior art mold block assemblies accommodate the thermal stresses to which the mold blocks were subject. This resulted in castings with cracked or otherwise striated surfaces, and unreliable operation of the machine. The mold block assemblies of the prior art were separately articulated (not chain-wise inter-linked) to enable easy replacement of damaged mold blocks; and each casting train was guided in conventional guide tracks (or roller-ways) which contributed to the problem of mechanical noise.

The solution to the problem of poor surface accuracy of a cast slab is provided in the present invention by chain-wise interlinking of the mold block assemblies in an elastic casting train; providing pairs of rollers in off-set roller ways; providing asymmetric loops to reduce the net effects of excitation in the bends by maintaining the inputs from positive and negative block acceleration out of phase; and, using micro-slitted mold block faces to relieve thermal stresses.

SUMMARY OF THE INVENTION

It has been discovered that chain-wise interlinking of contiguous mold block assemblies is essential to provide operation of a continuous casting machine essentially free of mechanical noise, and such chain-wise linking can only be provided when each mold block assembly is elastically hinged by dual parallel hingepins, spaced-apart in the casting direction (x-axis), as the mold block assembly is carried between opposed, transversely (y-axis) spaced-apart guide rails of each carriage track. The displacement of each mold block assembly in the casting direction is essentially independent of the displacement of a next-adjacent mold block assembly provided said displacement does not exceed about 0.025".

It is therefore a general object of this invention to provide a continuous block caster with the aforesaid chainwise linking of mold block assemblies having elastic hinge means to compensate for variation in block-to-block (center-line) distance caused by kinematic phenomena, including thermally induced variations in the dimensions of individual blocks as a function of their position in each track during operation, and mechanical tolerances necessary to assemble the mold blocks in the carriage tracks.

It has also been discovered that when a casting train of elastically hinged mold block assemblies are driven by opposed-torque gearing, the block faces of adjacent blocks may be maintained in essentially contiguous, substantially smoothly planar (in the cooling zone and in the casting zone), or smoothly arcuate (in the bends) relationship with each other. Although thermal loads cause separation of mold blocks in the casting direction, such separation is permitted by the elastic hinges without permitting the faces of those mold blocks to be displaced from their contiguous, smoothly planar configuration. The result is that the surface quality of the cast slab is smoothly planar.

It is therefore a general object of this invention to provide a continuous casting machine in which, during operation, successive rectangular mold blocks and the faces thereof in the cooling zone are essentially contiguous, and the elastic hinges are undeflected in the casting direction; and successive mold blocks in the casting zone are spaced-apart in the casting direction, as permitted by the elastic hinges, but the faces of the blocks are essentially contiguous and essentially planar.

It has also been discovered that the mold block assemblies of any casting train of a continuous casting machine, may be guided in generally horizontal guide tracks (rollerways) by guide rollers which are afforded no measurable tolerance relative to their vertical displacement, if transversely spaced-apart, coaxial, inboard and outboard rollers are provided at each end of a carriage block (of a mold block assembly), and the guide rollers ride on separate, vertically and transversely spaced-apart, inboard and outboard roller-ways.

It is therefore a general object of this invention to provide a continuous casting machine comprising mold block assemblies having an inboard and a outboard guide roller near each end, each guide roller at each end riding on a lower roller-way vertically and transversely spaced apart from another upper roller-way.

It has still further been discovered that microslitted mold block faces are essential to modulate interface resistance, to influence freezing of a molten non-ferrous metal such as aluminum, and to maintain intimate contact of the entire face of each block in contact with the surface of the metal in the casting cavity, so as, unexpectedly, greatly to influence both the magnitude and direction of reaction forces transmitted through the mounting means which support the mold blocks, both depending upon the location of the mold block assemblies in the casting train during operation.

It is therefore a general object of this invention to provide a chain-wise interlinked casting train of mold block assemblies supporting mold blocks which have faces microslitted sufficiently to minimize distortion of the blocks.

It is still another general object of this invention to provide a camber, front-to-back in each train of mold block assemblies in the cooling zone, so as to bias the mold blocks (in those assemblies) as if held in a catenary, thus maintaining the abutting relationship of each in the cooling zone.

It is a specific object of this invention to provide a chain-wise interlinked elastic train of mold block assemblies, each supported by support means, and dual longitudinally (x-axis) spaced-apart hingepins coaxially aligned, during assembly of the mold block assemblies, with twin transversely (y-axis) oppositely spaced-apart dual roller means, each journaled in roller blocks mounted at each end of a carriage block, each of the dual rollers riding inboard and outboard on vertically and transversely spaced-apart ("off-set") roller-ways in the frame of the machine; and, a resulting configuration in which the elastic hinges maintain a hingepin directly vertically above the upper contiguous edges (along the width of the block, y-axis) of mold blocks at all times, or, equidistantly between the upper edges, if the mold blocks are gapped.

It is a specific object of this invention to provide a continuous casting machine with casting trains of plural aforedescribed mold block assemblies in asymmetrical paths in a frame having opposed off-set roller-ways, each mold block assembly carried by dual spaced-apart hingepins which at assembly, are coaxial with twin roller means comprising a pair of dual inboard and outboard rollers supported in the off-set roller-ways; an opposed-torque gearing to drive the casting trains; rectangular copper mold blocks having a thickness in the vertical direction (z-axis) in the range from about 2.5" (inches) to about 6" thick, a length in the casting direction (x-axis) in the range from about 3" to 12" long, a width in the transverse direction (y-axis) in the range from about 4 ft to 8 ft, and microslits of predetermined controlled width and depth in the faces of the blocks in the range from about 0.005" to about 0.010" wide and from about 1" to 2" deep, there being about 1 slit per transverse inch of the face; and, elastic hinge means to permit the blocks to move apart no more than 0.050", yet to maintain contiguous faces of adjacent blocks during operation of the machine.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations, like reference numerals refer to like elements, and in which:

FIG. 4 is a detail side elevational view of a hinge block illustrating the position of an inserted hinge eyelet when a spring means is decompressed and stores a minimum amount of energy.

FIG. 5 is a detail side elevational view of a hinge block illustrating the position of an inserted hinge eyelet when the spring means is compressed and stores a maximum amount of energy.

FIG. 6 is a detail side elevational view of a row of interdigitated clevises of hinge eyelets inserted in hinge blocks which become separated because of distortion of the mold blocks.

DETAILED DESCRIPTION OF A PREFERRED EMBODIMENT

Since the mold blocks are to be snugly confined, captive within each track, the chain of contiguous mold blocks cannot be longer than the length of the track. If the chain was longer by even a few mils (thousandths of an inch) assembly of the blocks in the track would be difficult and operation of the track out of th question.

This problem is solved by designing the mold blocks and track with tolerances sufficient to ensure that the track length will be longer than the chain length (of contiguous mold blocks). Utilizing an elastic hinge permits the requisite elongation of chain length to permit installation of the last hingepin when the track is assembled. In addition, the hinge permits sufficient elasticity, more specifically, displacement in the casting direction, to maintain desirable block-to-block abutment in the mold cavity, without undue pressure sufficient to cause distortion of the faces of the blocks.

Figure 1:
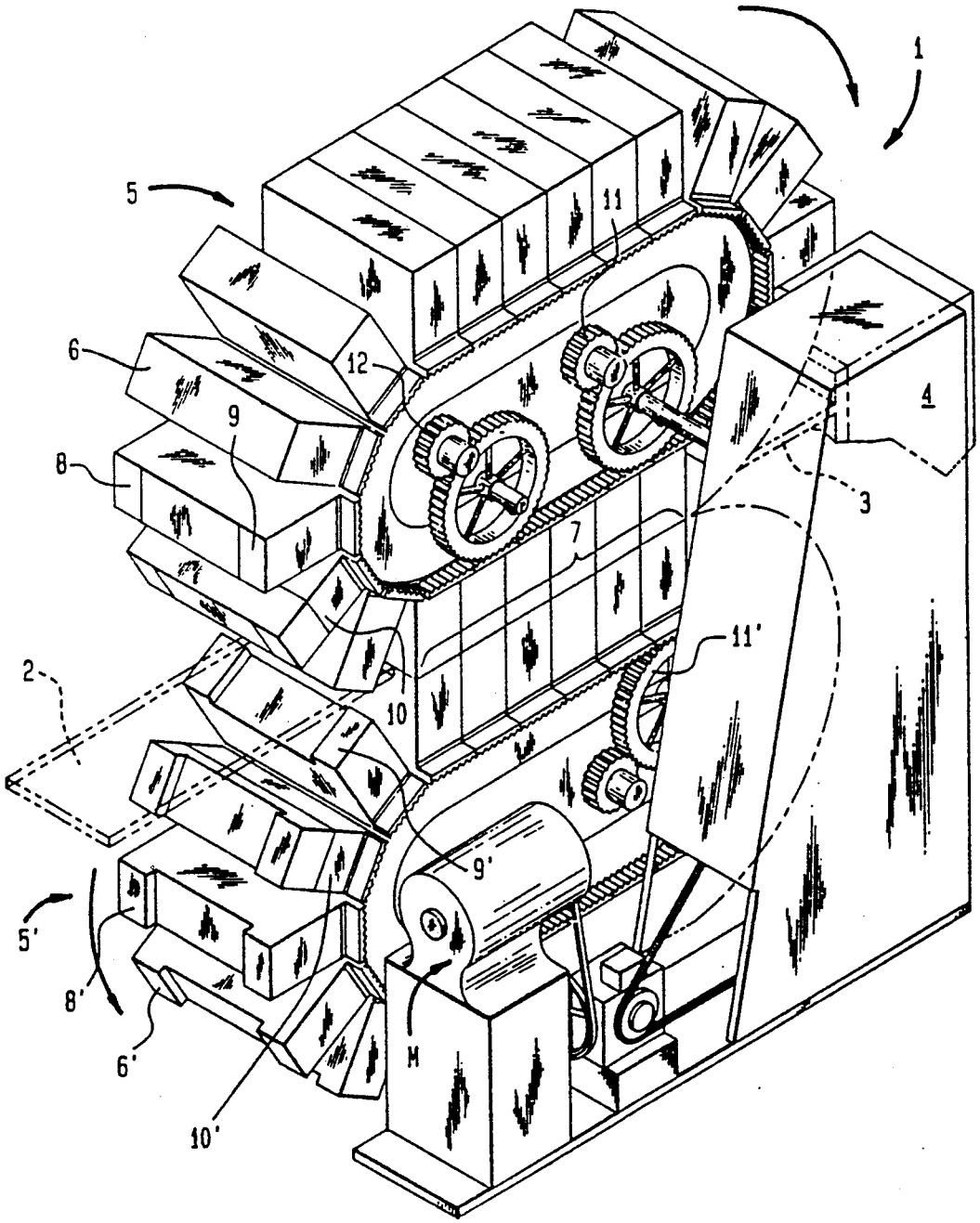
FIG. 1 is a diagrammatic perspective view of the block caster showing the opposed casting trains.

Schematically illustrated in FIG. 1 is the block caster, referred to generally by reference numeral 1, which has the general appearance of a prior art machine. The arrows indicate the direction in which each casting train is driven. In operation, the machine continuously casts a slab 2 of metal formed from molten metal flowing from the nozzle 3 of a tundish 4 (shown in phantom outline). Any molten metal which is castable may be cast in a block caster, but in the preferred embodiment the metal cast is a non-ferrous metal, specifically aluminum.

The block caster 1 comprises a pair of upper and lower casting trains, referred to generally by reference numerals 5 and 5', configured as twin loops which define the path of each train. Each casting train 5 and 5' comprises a multiplicity of endlessly connected mold block assemblies 6 and 6' respectively, which are essentially identical to each other with respect to their structural components. The mold block assemblies 6 and 6' come together facing each other, preferably between side dams (not shown), and move synchronously over the length of one side of the loops, to define a mold cavity 7.

The mold blocks are preferably generally U-shaped (shown), or L-shaped. The projections 8 and 9 of the U project from the surface ("face") of each mold block to define a channel portion of the mold cavity 7. When the projections 8 and 9 of mold blocks in the upper casting train come into contact with corresponding opposed projects 8' and 9' of the mold blocks of the casting train 5' the mold cavity 7 is formed.

In an analogous manner, if the mold blocks are L shaped, each having a single projection at one end, then the mold cavity is formed when several of the projections in the upper casting train contact the opposed faces of mold blocks in the lower casting train, and vice versa.

It is not essential that the mold blocks be provided with projections to contain the casting at its sides. The function of the projections may be supplied with opposed side dams, one on each side of each casting train, which side dams travel synchronously with the casting trains. The inner faces of the side dams contact the ends of the mold blocks and confine the metal. As stated hereinabove, such side dams may be provided even if the mold blocks are U- or L-shaped, and provided with projections.

Figure 3:
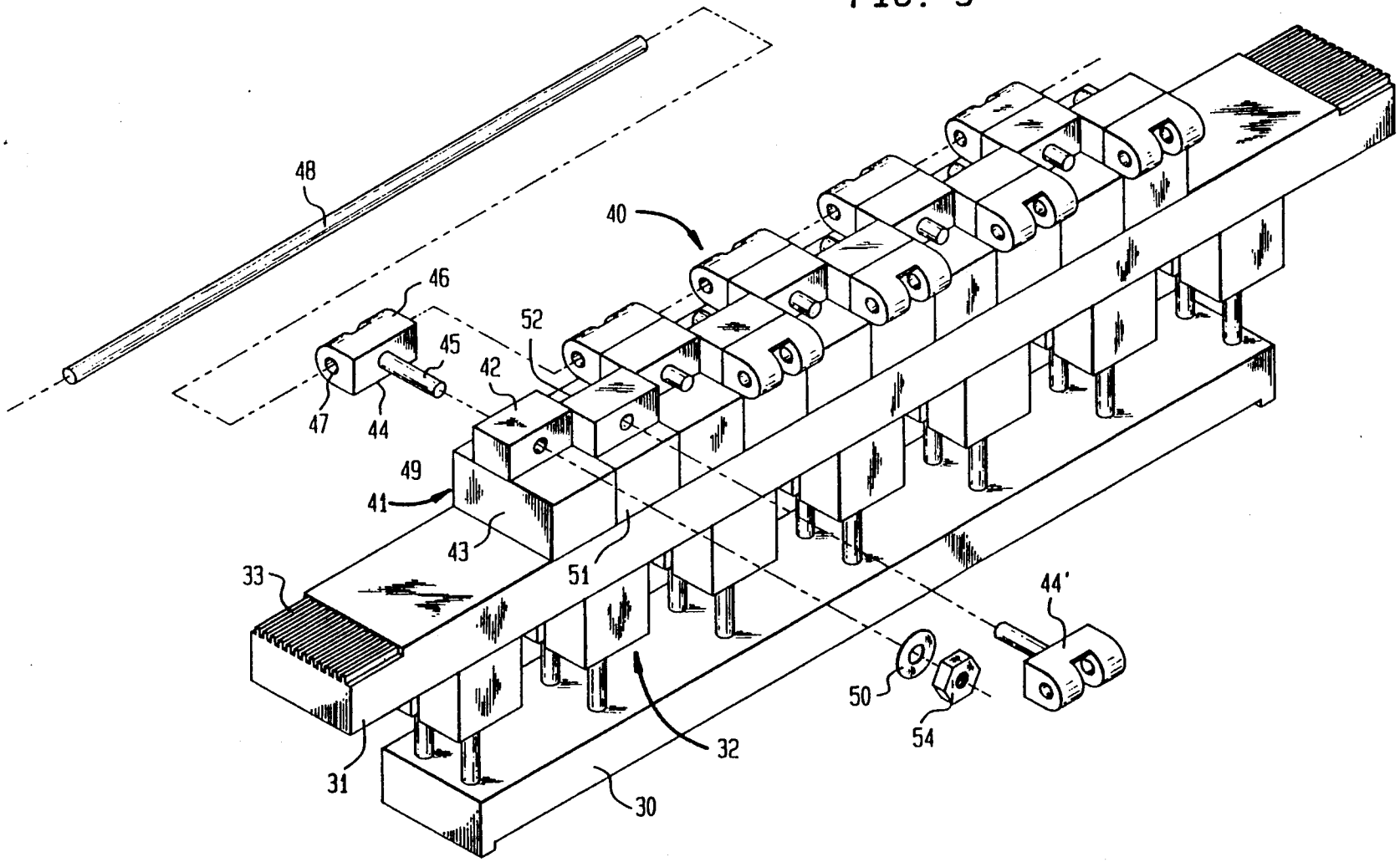
FIG. 3 is a schematic illustration in a partially exploded view of a preferred embodiment of a mold block assembly showing the disposition of its components.

The mold blocks are supported by supporting and fastening means 10, details of which are more clearly shown in FIG. 3, typically plural mounting units linearly spaced apart about equidistantly along the length of the upper portion of a mold block assembly. The mounting units permit such relative movement between the mold block and the carriage block as is necessary due to forces on the face of the mold block. Details of the mounting units are unnecessary since the mounting means, by itself, forms no part of this invention.

The upper casting train 5 is driven by a pair of drive gear assemblies 11 and 12, and the lower casting train 6' is driven by a pair of drive gear assemblies 11' and 12' (not shown). In operation, the torque provided by each drive gear assembly is adjusted to provide an opposed torque on the mold block assemblies in the casting zone to control their movement and maintain them essentially in block-to-block contact as the blocks travel through the mold cavity.

Molten metal enters the mold cavity 7 at the upstream end and emerges as a cast slab 2 at the downstream end, thus establishing the casting direction. Each drive gear assembly is driven by an electric motor M, only one of which is shown. The desired speeds at which the casting units are synchronously driven are maintained by computer control according to the demands of the various process parameters.

Though not evident in FIG. 1, the elongated oval shape of each casting train is not symmetrical about a plane parallel to a lateral plane through the mold cavity. This asymmetry of each train is illustrated in the diagram, shown in FIG. 2, of the path of the upper casting unit 3 which path defines the loop 13 comprising opposed generally semicircular portions or "bends" 14 and 15 connected by upper and lower linear sections or "straights" 16 and 17 respectively.

The mold block assemblies in each loop are necessarily subjected to a thermal cycle in which they (a) are heated rapidly when they come in contact with the molten metal at the molten end of the mold cavity, (b) continue to be heated as they travel through the casting zone, in the casting direction (shown by the arrows), as molten metal solidifies into the slab in the mold cavity, (c) begin to cool after they leave the solid end and enter the bend 14, and (d) are further cooled in a cooling zone before they traverse bend 15 and re-enter the casting zone at the molten end.

The temperature of molten aluminum being cast is about 300° F., and the slab cools to about 1000° F. as it emerges from the casting zone, so that those portions of the mold block assemblies in contact with the molten metal are heated to near 900° F. while the rest of the mold block is at about 400° F. The entire mold block gradually then heats up to about 750° F. as it enters bend 14. The mold block assemblies then go around the bend and enter the cooling zone where they are contacted with a cool fluid, typically a water spray, to cool them to about 400° F. at which temperature they enter bend 15 prior to re-entering the casting zone.

Figure 2:
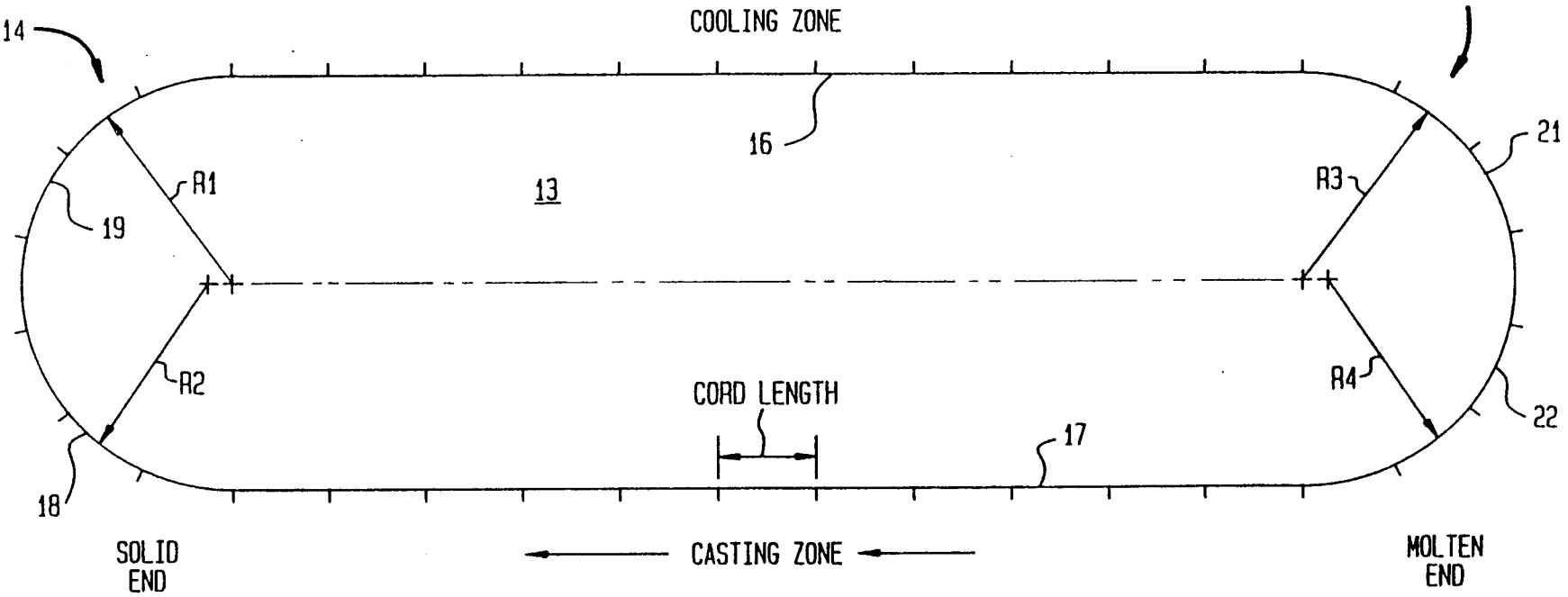
FIG. 2 is a schematic representation of the asymmetrical path of each casting train.

Reverting to FIG. 2, bend 14 consists of smoothly joined quadrants 18 and 19 one having a (first) radius greater than that (second radius) of the other by at least 10 percent and each of the radii is in the range from about 1.5 to about 5 times the length (in the casting direction) of the mold block, and the centers of each quadrant are off-set relative to each other in the casting direction. In an analogous manner, bend 15 consists of smoothly joined quadrants 21 and 22 one having a (third) radius greater than that (fourth radius) of the other, and the centers of each quadrant 21 and 22 are off-set relative to each other in the casting direction. Moreover, typically no two of the four radii of the four quadrants are the same.

The Xs marked along the loop represent the locations at which the lateral edges (widths) of the blocks abut, and indicate that 35 mold block assemblies are used in the train.

The number of mold block assemblies in a casting train is arbitrary being a function of the physical exigencies predetermined by process characteristics and the economics of constructing and operating the machine. For the casting of aluminum, from 20 to about 100 mold block assemblies may be used in each casting train, though there is no physical reason for using a much greater number, if desired. In practice, a commercial machine would not have less than 20 mold block assemblies.

Details of a mold block assembly not visible in FIG. 1 are shown in FIG. 3, in which a mold block assembly 6 comprises a rectangular mold block 30 supported from a carriage block 31 by a preferred supporting and fastening means 10 (in FIG. 1), here shown as mold block mounting means 32 which is transversely disposed (along the y-axis), so all the blocks of a casting train travel in the casting direction oriented at right angles to the direction of casting. The blocks are biased, one against the other through the casting zone to form a seamless mold cavity with planar uppe and lower walls with the aid of opposed torques generated by the drive gear assemblies of each train.

To drive the mold block assemblies, each carriage block 31 is provided, near its ends with a rack 33 which is adapted to be drivingly engaged with the drive gears 11 and 12 for the carriage blocks. On each carriage block, intermediate the ends, is mounted hinge means referred to generally by reference numeral 40, preferably including plural stepped hinge blocks 41 having upper and lower portions 42 and 43 respectively. In the upper portion 42 of each hinge block is slidably inserted a hinge eyelet 44. Each hinge eyelet 25 comprises an eyelet shaft 45 threaded at one end. The other end terminates in a clevis 46 the sides of which have coaxial through-bores 47 in which are journaled a hingepin 48.

The upper portions 42 and 52 of hinge blocks (10 are shown) 41 and 51 are staggered so that every other eyelet on the side of the hinge eyelet 44 has the hingepin 48 journaled in it. The hinge eyelet 44', shown oppositely disposed relative to hinge eyelet 44 with which it is identical in configuration, and every other hinge eyelet on the side of the hinge eyelet 44', will journal a second hingepin (not shown). Thus it is seen that the mold block assembly 6 is hingedly connected with two hingepins, one on either side.

Each hinge block 41 is provided with a bore 49 through which the threaded end of a hinge eyelet shaft 45 is passed and secured with a nut 54. A spring washer 50 with a predetermined spring constant is secured between the nut 53 and the upper portion 42 of the hinge block 41. The spring washer 50 permits displacement of the hingepin in the casting direction, and provides the elasticity in each casting train.

Referring now to FIG. 4, there is shown a side elevation view of a hinge block 51 in the upper portion 52 of which the position of the eyelet 44' is illustrated when the spring washer has a minimum energy stored (decompressed), and the edge 55 of the mold block is directly below and aligned with the vertical centerline through the bore 47' of clevis 46'. In this position, the lateral face of the mold block below edge 55 would be contiguous and coextensive with the lateral face 57 of a contiguous mold block.

The face of the mold block is shown recessed, as dotted line 57 because the mold block shown in FIG. 3 has end projections. The vertical dotted lines shown represent the microslits 58 in the face. Such microslits are cut precisely in the face of each block to specifications within the range set forth hereinabove. The direction in which the slits are cut is not narrowly critical. If desired, some of the microslits may be cut parallel to the x-axis and the remaining parallel to the y-axis to form a rectangular crosshatching. It is preferred however, to cut the microslits at an acute angle to the x- and y-axes, so that the pattern on the block's face is a diamond cross-hatching.

The manner in which the microslits are cut into the face of the blocks is not critical provided they are cut with due precision. A preferred manner of cutting such microslits is by EDM (electro-discharge machining) which is well known in the art.

In the side elevation of the same hinge block 51 shown in FIG. 5, the position of the hinge eyelet 44' is shown when thermal conditions force separation of the lateral faces of contiguous mold blocks, and the spring washer is compressed. Such separation of the mold blocks may be as much a 0.050" which requires that the vertical centerline through the bore 47' of the clevis 46' be displaced 0.025".

Referring now to FIG. 6 there is shown a pair of hingedly connected mold blocks 41 and 51, the lateral faces 55 and 56 of which blocks have been forced apart over the maximum deflection of 0.050". As seen the clevises 46 and 46' of the eyelets are interdigitated (as in a piano hinge) to afford maximum bearing means for the hingepin journaled therein. Such interdigitation of hingepins on either side of each mold block assembly results in a meshed chain-wise interlinkage of mold block assemblies in each casting train.

Figure 7:
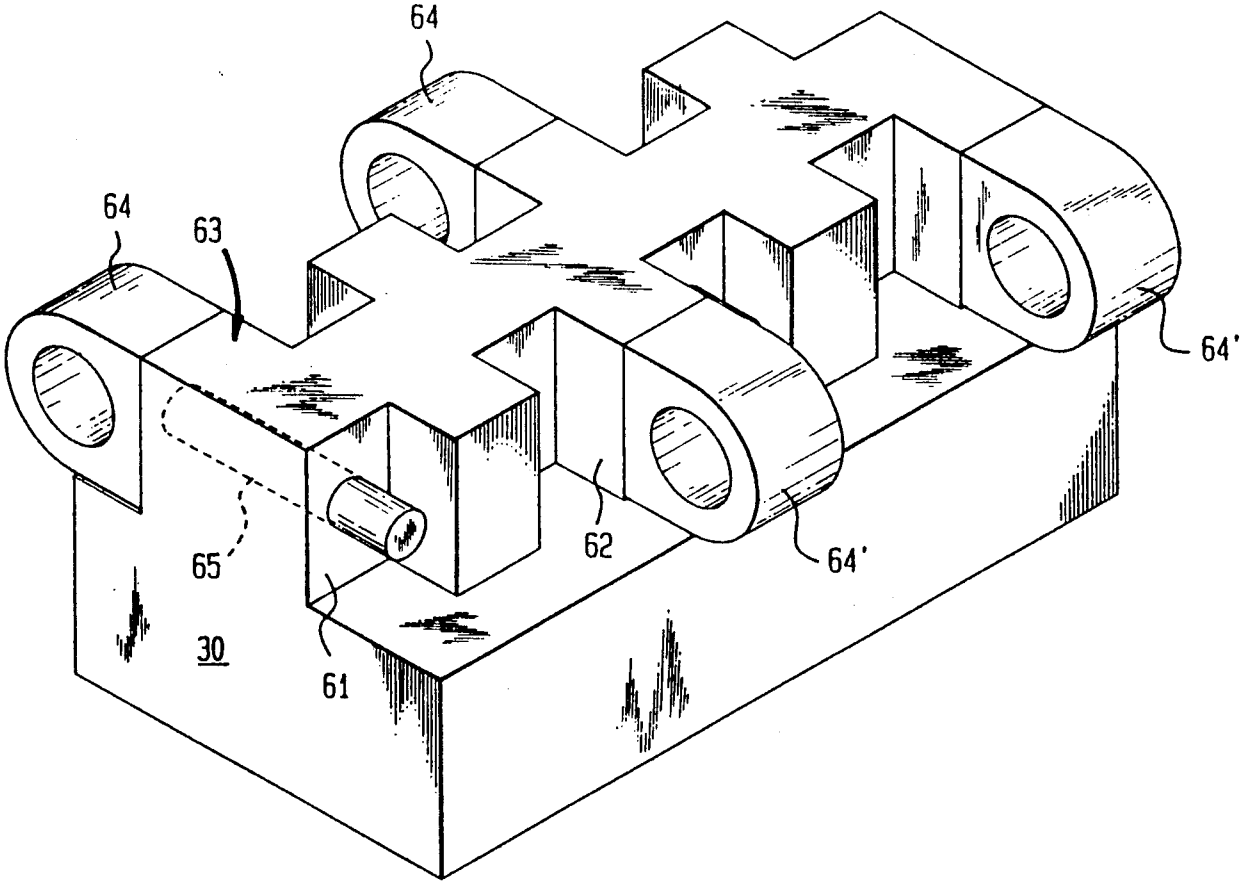
FIG. 7 is a schematic illustration of stepped hinge blocks having upper portions staggered and spaced apart because single eyelets (instead of clevises) do not permit a piano hinge configuration.

It is not essential that the hingepins be interdigitated if adequate bearing means is otherwise provided and the mold block assemblies are chain-wise interlinked. For example, shown in FIG. 7 are hinge blocks 61 and 62 in which hinge eyelets 64 are inserted. Since only one eyelet is provided, instead of a clevis with a recess, the eyelets on contiguous mold block assemblies must be spaced apart so that the hinge pins (not shown) through eyelets 64' will clear the ends (with the spring and nut securing the eyelet in the upper portion 63 of the hinge block) of the hinge eyelet shafts 65.

Figure 8:
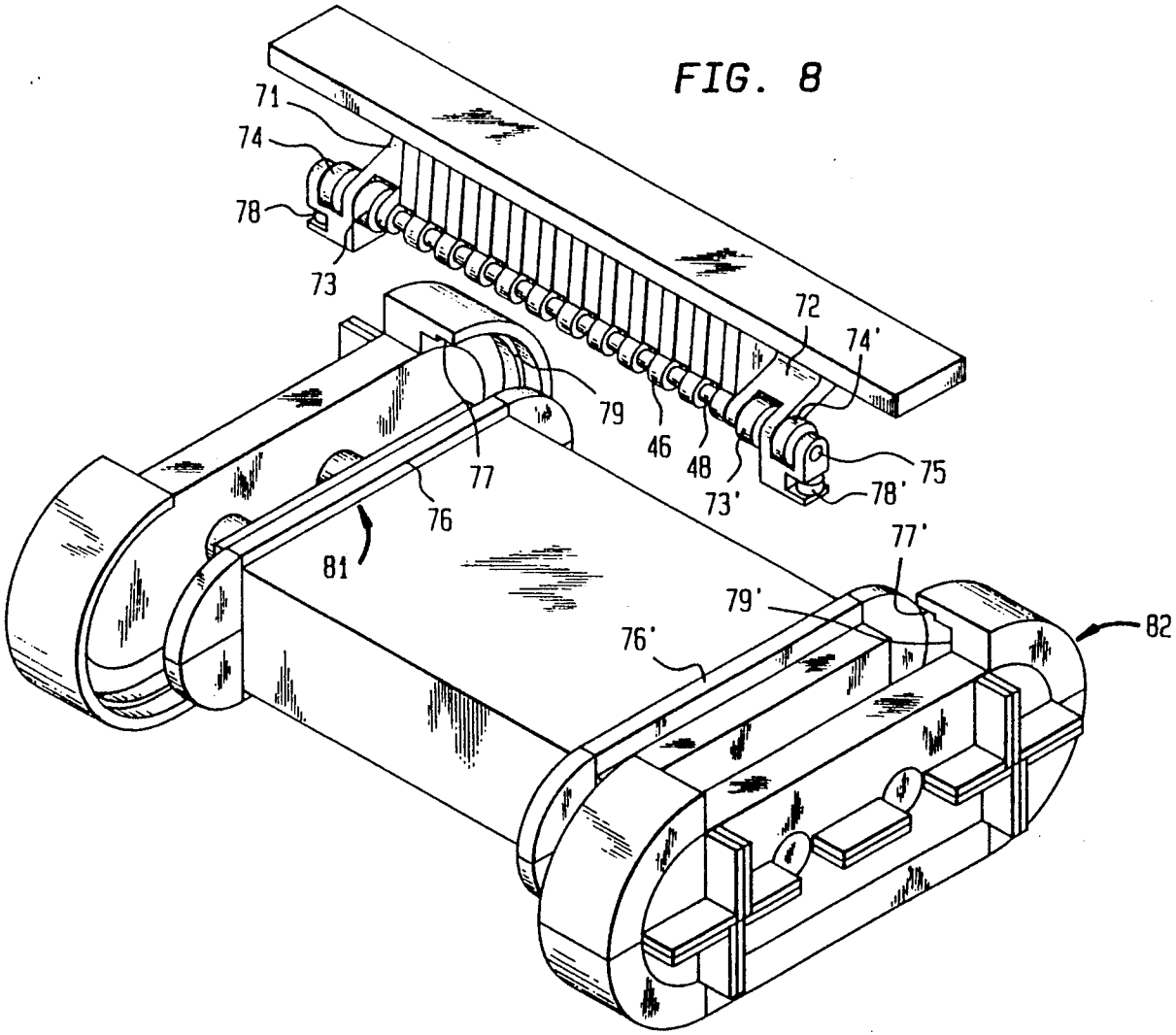
FIG. 8 is a diagrammatic exploded perspective view illustrating generally, the main structural features of the frame of a block caster which determines how a carriage block assembly is guided in its path around each loop of a casting train.

Referring now to FIG. 8 there is shown an exploded perspective view of a carriage block assembly indicated generally by reference numeral 70, and the track assembly indicated generally by reference numeral 80, in which a casting train of carriage blocks rides. Each carriage block assembly 70 includes the mounted stepped hinge blocks 41 and 51, staggered as described hereinabove with the hinge eyelets 44 and 44' installed.

Shown are spaced-apart eyelets 44 having clevises which carry the hingepin 48 shown installed without a continuous carriage block. Near opposite ends of the carriage block are roller blocks 71 and 72 in each of which twin rollers 73 and 74, and 73' and 74' respectively, are rotatably mounted, inboard and outboard, on a common stub axle 75. The four rollers 73, 74, 73' and 74' are coaxial, and also coaxial with the hingepin 48, the overall length of which is less than the distance between the inner edges of roller blocks 71 and 72. To install the hingepin, the stub axles used are hollow so that the hingepin can be slidably inserted into the aligned bores 47 of the clevises 46. The hollow bores of the stub axles are then plugged.

In an actual assembly, it will be appreciated that the hingepin 48 will, in addition, be inserted as described above through the bores 47' of clevises 46' (of hinge eyelets 44') of a contiguous carriage block. As they are assembled chainwise interlinked, the rollers 73 and 74 are set in place so that rollers 73 and 73' rest on inboard roller ways 76 and 76' and rollers 74 and 74' rest beneath roller ways 77 and 77'. The paths of the rollers on the rollerways is fixed since they are mounted on the carriage block which, unlike the mold block mounted on the carriage block, is substantially insulated from thermal changes. Because the expansion and contraction of the mold block causes displacement of the hingepin, it will now be evident that during operation, the hingepin will only be coaxially aligned with the rollers when the mold block assembly is under conditions close to those at which the hingepin was inserted through the hinge eyelets.

It will be appreciated that instead of dual rollers on each side, and upper and lower twin guide tracks, a single roller and a single guide track which provides adequate tolerance for the roller, may be used, as has been done in the prior art. Such a guide system cannot have guide rails which are essentially free of tolerance. The use of dual rollers on each side allows the instantaneous velocity at the point of contact (tangent) of each roller to be zero. This point of contact for the inboard roller is diametrically opposite the point of contact of the outboard roller. The unexpected advantages of using dual rollers is that they provide an extra dimension of latitude with respect to accommodating forces which would otherwise tend to bind the rollers in their tracks.

Figure 9:
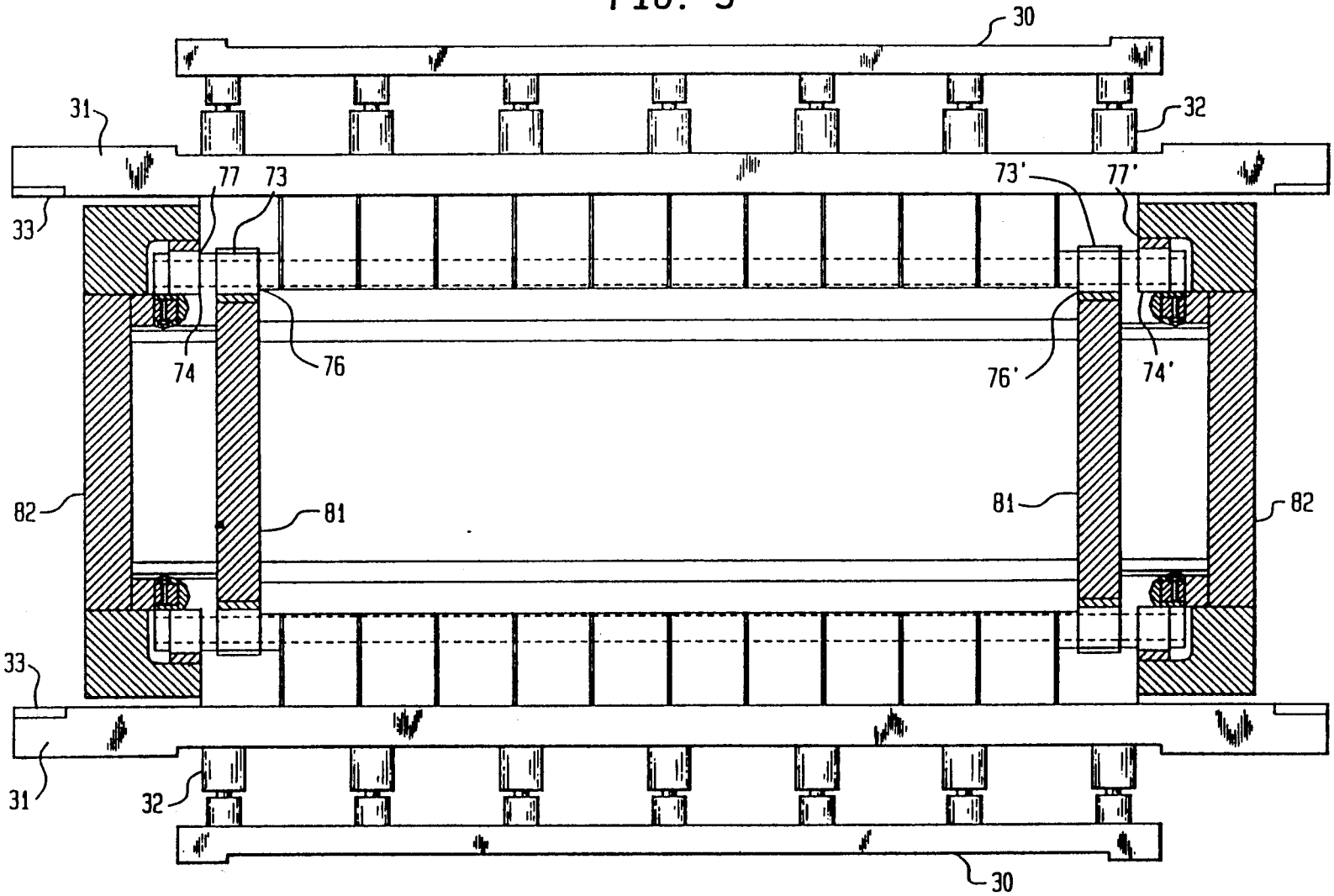
FIG. 9 is a front elevation view of a single casting train schematically representing the relative positioning in the frame of a block caster, of mold block assemblies in the cooling zone (upper) and casting zone (lower) straights of a loop while the mold block assemblies are guided in guide tracks in the frame.

The geometrical configuration of a casting train using carriage blocks carried by a twin set of dual rollers guided in off-set tracks will be better appreciated by reference to FIG. 9. In either the upper or lower straights of a loop, the forces generated by distortion of the faces of the mold blocks 30 vary so greatly, that at some locations in a loop, the carriage blocks are forced downwards, and at other locations they are forced upwards. It will now immediately be evident that a single roller confined in a channel guide in tangential contact with the upper and lower surfaces of a roller, will bind when subjected to large variations in upward and downward forces. Therefore, for the reasons stated above, it is not practical to provide a single roller in a roller-way in which there is no measurable tolerance for vertical displacement of the single roller.

Referring to the upper carriage blocks 31, as they are carried through the upper straight of a loop, it is seen that inboard rollers 73 and 73' at one end, carried by hingepins in hinge blocks 41, rest on lower (inboard) roller-ways 76 and 76' provided in frame member 81. The outboard rollers 74 and 74' at the other end rest on upper (outboard) rollerways 77 and 77' provided in frame member 82. The inboard rollers 73 and 73' may carry the major portion of, or the entire load, imposed by the upper carriage block, or, if forces tend to lift up on the carriage block, the inboard rollers may carry only a minor portion, or none of the load. The load not carried by the inboard rollers is carried by the outboard rollers riding in the upper roller-ways 77 and 77'. The roller stub axles 75 are designed to provide a predetermined flexure as a function of the loading of the rollers.

In an analogous manner it will now be evident that inboard and outboard rollers 73, 73' and 74, 74' respectively of the lower carriage block in FIG. 8 discharge the same function as they do in the upper straight.

To ensure that the mold blocks are contiguous in the cooling zone, the roller-ways 73, 73', and 77, 77' are tapered downwardly toward the vertical central plane transverse to the casting direction, so as to bias the mold blocks as if in a catenary. The roller-ways in the casting straight are not tapered.

In addition to the twin set of dual rollers 73, 73', and 74, 74', it is preferred to provide third rollers 78, 78' to limit the side-to-side movement of each casting train during operation. Each third roller is mounted near each end of the carriage block, but the axis of rotation of each third roller is orthogonal to the axis of rotation of the dual rollers. The third rollers ride on roller-ways 79 and 79' in the frame 82, and since the roller-ways 79, 79' serve to confine the transverse movement of the train, they are parallel even if the roller-ways 76, 76' and 77, 77' are tapered.

It will now be evident that the importance of maintaining the mold block assemblies in essentially block-to-block contact while they are driven through the casting zone is to ensure that the faces of the mold block assemblies provide a smoothly planar surface against which the casting is in essentially coextensive contact continuously while the mold blocks assemblies are in contact with the semi-molten metal.

If there are gaps (spaces in the x-direction) between mold blocks, or "steps" (blocks off-set relative to one another in the vertical or z-direction) the surface of the casting is not smoothly planar. A non-planar surface is produced in prior art castings by a progression of steps diagrammatically illustrated in FIGS. 10–12, resulting in "bumps" referred to hereinabove.

Figure 10:
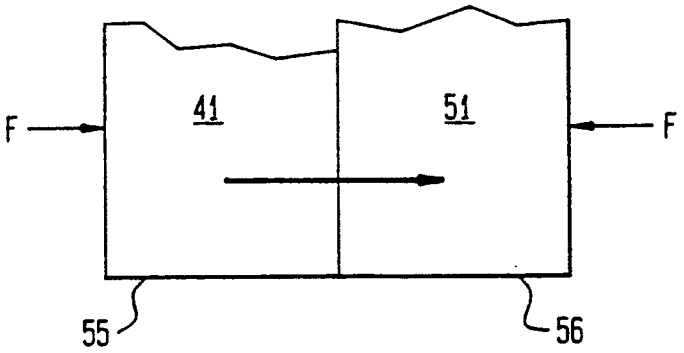
FIGS. 10–12 schematically illustrate the profile of the lower portions of next-adjacent mold blocks in a sequence which generates "bumps" o the transverse edges of contiguous blocks due to a succession of thermal cycles in a prior art block caster.

Referring to FIG. 10, there is illustrated a pair of contiguous mold blocks 41 and 51 biased against each other by a force F no greater than is necessary to maintain them in block-to-block contact in the casting direction, in a prior art block caster. In this position, prior to the blocks being heated, the faces 55 and 56 of the mold block are neither gapped nor stepped, but smoothly planar. In the Fig. the end projections of the mold block 30 shown in FIG. 3, are not shown for the purpose of this illustration.

Figure 11:
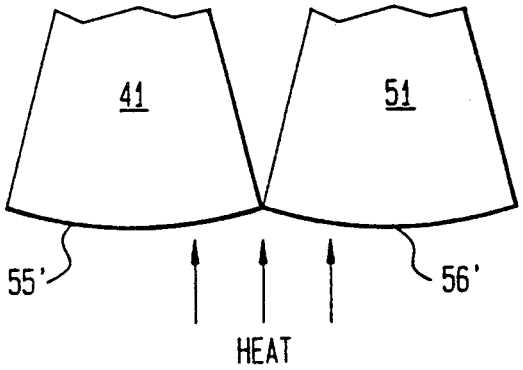
Figure 12:
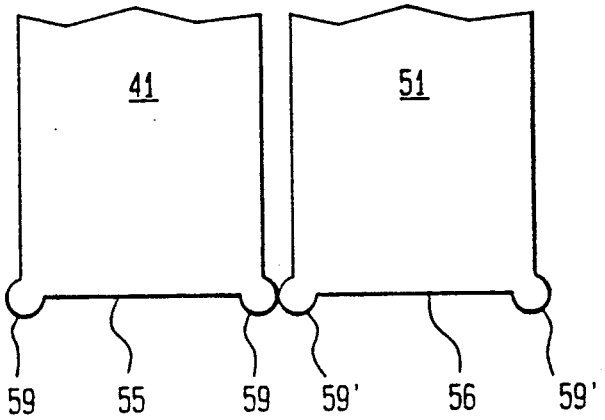

When the faces 55 and 56 of the blocks are heated sufficiently to distort them, as they are when they are heated to above about 600°-900° F., they become slightly convex, now seen as 55' and 56' in the side elevational view in FIG. 11. The blocks also deform in the transverse direction, again becoming slightly bowed (convex) though such bowing is not shown in FIG. 11. At the same time, expansion in the casting direction causes the face of the block (being hotter) to expand more than the rest of the block (being cooler). This expansion is generally progressive so that the end of the block presents a generally trapezoidal profile, shown greatly exaggerated in FIG. 11.

As the blocks are forced together by the forces of expansion, the edges of the blocks where the forces are concentrated, become deformed, as is evident by the protuberance of the edges beyond the cooled faces 55 and 56. These protuberances, referred to as a "bumps", become progressively more pronounced after multiple passes, and being thermally cycled many times through the casting zone.

Having thus clearly and objectively stated the problems to be solved in prior art block casters, and their solution by the invention disclosed herein, and having provided a detailed description and illustrations of the best mode of practicing the invention, it is to be understood that no undue restrictions are to be imposed by reason thereof, and particularly that the invention is not restricted to a slavish adherence to the details set forth herein.

We claim:

1. In a continuous casting machine for casting a slab of arbitrary cross-section and length, including a pair of oppositely disposed upper and lower casting trains having plural interconnected mold block assemblies; said upper casting train driven synchronously with said lower casting train, each in a path defining a loop having opposed side bends connected by lower straight segments wherein said mold block assemblies in two of said straight segments move together in spaced apart relationship to define a mold cavity;

the improvement comprising, elastic hinge means hingedly connecting each mold block assembly to a next-adjacent mold block assembly so as to chainwise interlink all said mold block assemblies, each of which is pivotable on said hinge means, and is simultaneously displaceable in the direction of movement of said mold block assembly.

2. The continuous casting machine of claim 1 wherein the displacement of each mold block assembly in the casting direction is essentially independent of the displacement of a next-adjacent mold block assembly provided said displacement does not exceed about 0.025".

3. The continuous casting machine of claim 1 wherein said elastic hinge means is adapted to permit a maximum displacement (in the casting direction) of said mold block assemblies sufficient to assemble each said casting train.

4. The continuous casting machine of claim 1 wherein said elastic hinge means comprises, dual parallel hingepins, spaced apart in the casting direction on either side of a mold block assembly, each hingepin journaled in a hinge eyelet which is displaceable in the casting direction, said hinge eyelet is slidably disposed in a hinge block mounted on a carriage block, and said hinge eyelet is secured in said hinge block, and, spring means cooperating with said hinge eyelet to permit a maximum predetermined displacement of one mold block assembly relative to another, in the casting direction.

5. The continuous casting machine of claim 3 wherein said casting train is driven by drive means comprising gear assemblies adapted to provide an opposed torque upon block assemblies in the casting zone, s id torque being sufficient to maintain said mold block assemblies driven essentially contiguously through said casting zone.

6. The continuous casting machine of claim 4 wherein said carriage block supports and is fastened to a rectangular mold block with supporting and fastening means, and said mold block is microslitted with a multiplicity of slits in its face to minimize distortion of the block under thermally induced kinematic forces, each slit being of predetermined width and depth in the range from about 0.005" to about 0.010" wide, and from about 1" to 2" deep.

7. The continuous casting machine of claim 6 wherein said hinge eyelet comprises a shaft threaded at one end with a clevis at the other; said spring means is a spring washer through which said shaft is inserted; and, said hingepin is rotatably disposed in through-bores of each clevis o hinge eyelets in adjacent mold block assemblies so that said hingepin is held in interdigitated clevises.

8. In a continuous casting machine for casting a slab of arbitrary cross-section and length, including a pair of oppositely disposed upper and lower casting trains having plural interconnected mold block assemblies; each mold block assembly comprising a mold block, a carriage block and supporting and fastening means securing said mold block to said carriage block; said upper casting train driven synchronously with said lower casting train in upper and lower guide track means, each in a path defining a loop having opposed side bends connected by lower straight segments wherein faces of mold blocks in said mold block assemblies move together in spaced apart relationship to define a mold cavity;

the improvement comprising, twin roller means mounted on each said carriage block, on either side thereof, each of said twin roller means comprising dual rollers coaxially mounted inboard and outboard in spaced apart relationship; and, said guide track means comprising off-set inboard and outboard roller-ways upon which said inboard and outboard rollers are rotatably translatable.

9. The continuous casting machine of claim 8 including in addition a third roller carried outboard of each of said twin rollers to limit side-to-side motion of each said casting train, said third roller having an axis of rotation at right angles to the axis of said twin rollers, and said third roller is rotatable against a third roller-way.

10. A mold block assembly for use in a continuous block caster, said mold block assembly comprising, a carriage block, a mold block and supporting and fastening means to secure said mold block so said carriage block;

said carriage block having fastened thereto, hinge block means in which hinge eyelets are secured with spring means cooperating with said hinge eyelets so as to permit said mold block to be displaceable in the casting direction, said hinge eyelets having journaled therein a hingepin which permits said mold block to be displaceable in the casting direction about 0.025".

11. The mold block assembly of claim 10 wherein said mold block has a rectangular face which is microslitted with a multiplicity of slits in its face to minimize distortion of the block under thermally induced kinematic forces, each slit being of predetermined width and depth in the range from about 0.005" to about 0.010" wide, and from about 1" to 2" deep.

12. The mold block assembly of claim 11 wherein each hinge eyelet comprises a shaft threaded at one end with a clevis at the other; said spring means is a spring washer through which said shaft is inserted; and, said hingepin is rotatably disposed in through-bores of each clevis of hinge eyelets in adjacent mold block assemblies so that said hingepin is held in interdigitated clevises.

13. In a continuous casting machine for casting a slab of arbitrary cross-section and length, including a pair of oppositely disposed upper and lower casting trains having plural interconnected mold block assemblies; said upper casting train driven synchronously with said lower casting train, each in a path defining a loop having opposed side bends connected by lower straight segments wherein said mold block assemblies in two of said straight segments move together in spaced apart relationship to define a mold cavity;

the improvement comprising, asymmetric side bends in said loop, said bends having differing radii the difference between which is sufficient to ensure that the periodicity of events which occur due to block acceleration in transitions from a linear to an arcuate path, and vice versa, are out of phase.

14. The continuous casting machine of claim 13 wherein each of said radii is in the range from about 1.5 to about 5 times the length (in the casting direction) of said mold block.

15. The continuous casting machine of claim 14 wherein each of said radii differs from another by at least 10 percent.

16. In a continuous casting machine for casting a slab of arbitrary cross-section and length, including a pair of oppositely disposed upper and lower casting trains having plural interconnected mold block assemblies; said upper casting train driven synchronously with said lower casting train, each in a path defining a loop having opposed side bends connected by lower straight segments wherein said mold block assemblies in two of said straight segments move together in spaced apart relationship to define a mold cavity; the improvement comprising, (a) elastic hinge means hingedly connecting each mold block assembly to a next-adjacent mold block assembly so as to chain-wise interlink all said mold block assemblies, each of which is pivotable on said hinge means, and is simultaneously displaceable in the direction of movement of said mold block assembly;

(b) twin roller means mounted on each said carriage block, on either side thereof, each of said twin roller means comprising dual rollers coaxially mounted inboard and outboard in spaced apart relationship; and, guide track means comprising off-set inboard and outboard roller-ways upon which said inboard and outboard rollers are rotatably translatable;

(c) asymmetric side bends in said loop, said bends having differing radii the difference between which is sufficient to ensure that the periodicity of events which occur due to block acceleraiton in transitions from a linear to an arcuate path, and vice versa, are out of phase; and, (d) each said mold block assembly comprising, a carriage block, a mold block and supporting and fastening means to secure siad mold block to said carriage block; said carriage block having fastened thereto, hinge block means in which hinge eyelets are secured with spring means cooperating with said hinge eyelets so as to permit said mold block to be displaceable in the casting direction, said hinge eyelets having journaled therein a hingepin which permits said mold block to be displaceable in the casting direction about 0.025".

17. The continuous casting machine of claim 16 wherein displacement of each mold block assembly in the casting direction is essentially independent of the displacement of a next-adjacent mold block assembly provided said displacement does not exceed about 0.025".

18. The continuous casting machine of claim 17 wherein said elastic hinge means comprises, dual parallel hingepins, spaced apart in the casting direction on either side of a mold block assembly, each hingepin journaled in a hinge eyelet which permits said mold block to be displaceable in the casting direction, said hinge eyelet is slidably disposed in a hinge block mounted on a carriage block, and said hinge eyelet is secured in said hinge block, and, spring means cooperating with said eyelet to permit a maximum predetermined displacement of one mold block assembly relative to another, in the casting direction.

19. The continuous casting machine of claim 18 wherein said carriage block supports and is fastened to a rectangular mold block with supporting and fastening means, and said mold block is microslitted with a multiplicity of slits in its face to minimize distortion of the block under thermally induced kinematic forces, each slit being of predetermined width and depth in the range from about 0.005" to about 0.010" wide, and from about 1" to 2" deep.

20. The continuous casting machine of claim 19 wherein each of said radii is in the range from about 1.5 to about 5 times the length (in the casting direction) of said mold block.

21. The continuous casting machine of claim 20 wherein said slits are cut in a pattern of diamond cross-hatching.

* * * * *